US005397402A

United States Patent [19]

Benford

[11] Patent Number: 5,397,402

[45] Date of Patent: Mar. 14, 1995

[54] SILICON STEEL STRIP HAVING MECHANICALLY REFINED MAGNETIC DOMAIN WALL SPACINGS AND METHOD FOR PRODUCING THE SAME

[75] Inventor: James G. Benford, Pittsburgh, Pa.

[73] Assignee: Allegheny Ludlum Corporation, Pittsburgh, Pa.

[21] Appl. No.: 252,305

[22] Filed: Jun. 1, 1994

Related U.S. Application Data

[62] Division of Ser. No. 978,202, Nov. 17, 1992.

[51] Int. Cl.[6] ..... H01F 1/04

[52] U.S. Cl. ..... 148/111; 148/113

[58] Field of Search ..... 148/111, 112, 113

[56] References Cited

U.S. PATENT DOCUMENTS

| | | | |
|---|---|---|---|
| 3,647,575 | 3/1972 | Fiedler et al. | 148/112 |
| 4,533,409 | 8/1985 | Benford | 148/111 |
| 4,613,842 | 9/1986 | Ichiyama et al. | 336/218 |
| 4,711,113 | 12/1987 | Benford | 72/197 |
| 4,742,706 | 5/1988 | Sasaki et al. | 72/197 |
| 4,770,720 | 9/1988 | Kobayashi et al. | 148/111 |
| 5,080,326 | 1/1992 | Price et al. | 266/103 |
| 5,123,977 | 6/1992 | Price et al. | 148/111 |

FOREIGN PATENT DOCUMENTS 59-172220 9/1984 Japan .

*Primary Examiner*—John P. Sheehan
*Attorney, Agent, or Firm*—Patrick J. Viccaro

[57] ABSTRACT

A grain oriented silicon steel strip and method are provided for producing the same wherein a chevron pattern of scribe lines mechanically refines the magnetic domain wall spacings. Multiple chevron patterns are formed to extend always transversely across the strip width.

7 Claims, 2 Drawing Sheets

SILICON STEEL STRIP HAVING MECHANICALLY REFINED MAGNETIC DOMAIN WALL SPACINGS AND METHOD FOR PRODUCING THE SAME

This is a division of application Ser. No. 07/978,202, filed Nov. 17, 1992.

CROSS REFERENCE TO RELATED APPLICATIONS

This application is related to U.S. patent application Ser. No. 07/977,584, filed Nov. 17, 1992; Ser. No. 07/978,204, filed Nov. 17, 1992; Ser. No. 07/977,359, filed Nov. 17, 1992; Ser. No. 07/977,345, filed Nov. 17, 1992; and Ser. No. 07/977,595, filed Nov. 17, 1992.

BACKGROUND OF THE INVENTION

1. Field of the Invention

This invention relates to grain oriented silicon steel strip having a mechanically refined magnetic domain spacing by patterns of scribe lines that change direction transversely of the strip so as to essentially traverse magnetic domain walls extending parallel to the rolling direction of the strip. More particularly, the scribe lines are arranged in a closely spaced parallel arrangement in the form of an array extending along the length of the strip with side-by-side arrays having scribe lines extending to intersecting points, thereby forming chevron patterns across the width of the strip.

2. Description of the Prior Art

Grain-oriented silicon steel is conventionally used in electrical applications, such as power transformers, distribution transformers, generators, and the like. The steel's ability to permit cyclic reversals of the applied magnetic field with only limited energy loss is a most important property. A reduction of this loss, which is termed "core loss" is highly desirable in the aforesaid electrical applications.

In the manufacture of grain-oriented silicon steel, it is known that the Goss secondary recrystallization texture, (110)[001] in terms of Miller's indices, results in improved magnetic properties, particularly permeability and core loss over non-oriented silicon steels. The Goss texture refers to the body-centered cubic lattice comprising the grain or crystal being oriented in the cube-on-edge position. The texture or grain orientation of this type has a cube edge parallel to the rolling direction and in the plane of rolling, with the (110) plane being in the sheet plane. As is well known, steels having this orientation are characterized by a relatively high permeability in the rolling direction and a relatively low permeability in a direction at right angles thereto.

In the manufacture of grain-oriented silicon steel, typical steps include providing a melt having on the order of 2–4.5% silicon; casting the melt; hot rolling; cold rolling the steel to final gauge typically of 7 or 9 mils, and up to 14 mils in one or more stages, with intermediate annealing when two or more cold rollings are used; decarburizing the steel; applying a refractory oxide base coating, such as a magnesium oxide coating, to the steel; and final texture annealing the steel at elevated temperatures in order to produce the desired secondary recrystallization and purification treatment to remove impurities such as nitrogen and sulfur. The development of the cube-on-edge orientation is dependent upon the mechanism of secondary recrystallization wherein, during recrystallization, secondary cube-on-edge oriented grains are preferentially grown at the expense of primary grains having a different and undesirable orientation.

As used herein, "sheet" and "strip" are used interchangeably and mean the same unless otherwise specified.

It is also known that through the efforts of many prior art workers, cube-on-edge grain-oriented silicon steels generally fall into two basic categories: first, regular or conventional grain-oriented silicon steel; and second, high permeability, grain-oriented silicon steel. Regular, grain-oriented silicon steel is generally characterized by a permeability of less than 1870 at 10 Oersteds. High permeability, grain-oriented silicon steels are characterized by higher permeabilities which may be the result of composition changes alone or together with process changes. For example, high permeability silicon steels may contain nitrides, sulfides, selenides, and/or borides which contribute to the particles of the inhibition system which is essential to the secondary recrystallization process for the steel. Furthermore, such high permeability silicon steels generally undergo greater cold reduction to final gauge than regular grain oriented steels. A heavy final cold reduction on the order of greater than 80% is generally made in order to facilitate the high permeability grain orientation. While such higher permeability materials are desirable, such materials tend to produce larger magnetic domains than conventional material. Generally, larger domains are detrimental to core loss.

It is known that one of the ways that domain size and thereby core loss values of electrical steels may be reduced occurs when the steel is subjected to any one of various practices designed to induce localized strains in the surface of the steel. Such practices may be generally referred to as "domain refining by scribing" and are performed after the final high temperature annealing operation. If the steel is scribed after the final texture annealing, then a localized stress state in the texture-annealed sheet is induced so that the domain wall spacing is reduced. These disturbances typically are relatively narrow, straight line patterns, or scribes, generally spaced at regular intervals. The scribe lines are substantially transverse to the rolling direction and typically are applied to only one side of the steel.

In fabricating electrical steels into transformers, the steel inevitably suffers some deterioration in core loss quality due to cutting, bending, and construction of cores during fabrication, all of which impart undesirable stresses in the material. During fabrication incidental to the production of stacked core transformers and, more particularly, power transformers in the United States, the deterioration in core loss quality due to fabrication is not so severe that a stress relief anneal (SRA), typically about 1475° F. (801° C.), is essential to restore properties. For such end uses, there is a need for a flat, domain-refined silicon steel which need not be subjected to stress relief annealing. In other words, the scribed steel used for this purpose does not have to possess domain refinement which is heat resistant.

However, during the fabrication incidental to the production of most distribution transformers in the United States, the steel strip is cut and subjected to various bending and shaping operations which produce more working stresses in the steel than in the case of power transformers. In such instances, it is necessary and conventional for manufacturers to stress relief anneal (SRA) the product to relieve such stresses. During stress relief annealing, it has been found that the beneficial effect on core loss resulting from some scribing techniques, such as mechanical and thermal scribing, are lost. For such end uses, it is required and desired that the product exhibit heat resistant domain refinement (HRDR) in order to retain the improvements in core loss values resulting from scribing.

In referring now to certain prior teaching, U.S. Pat. No. 4,533,409, issued Dec. 19, 1984 and U.S. Pat. No. 4,711,113, issued Dec. 8, 1987, disclose a method and apparatus for scribing a grain-oriented silicon steel to refine the grain structure by passing the cold strip through a roll pass defined by an anvil roll and scribing roll having a surface with a plurality of projections extending along and generally parallel to the roll axis. The anvil roll is typically constructed from a material that is relatively more elastic than the material from which the scribing roll is constructed. Preferably, the scribing roll is constructed from steel and the anvil roll is constructed from rubber. The process described in U.S. Pat. No. 4,711,113, may be performed after final texture annealing but the domain refinement achieved is not maintained through the usual stress relief annealing temperatures.

U.S. Pat. No. 4,742,706, issued May 10, 1988, discloses an apparatus for imparting strain to a moving steel sheet at linear spaced-apart, deformed regions. The apparatus includes a strain imparting roll having a plurality of projections as in the above described U.S. Pat. No. 4,711,113, except that the projections are formed on a spiral relative to the axes of rotation of the roll. The apparatus of the '706 patent also includes a press roll, a plurality of back-up rolls and a fluid pressure cylinder interconnected so as to control pressure against the press roll.

U.S. Pat. No. 4,770,720, issued Sep. 13, 1988 discloses a cold deformation technique wherein final texture annealed grain oriented silicon steel at as low as room temperature, and as high as from 50° to 500° C. (122° to 932° F.) is subjected to local loading, at a mean load of 90 to 220 kg/mm$^2$ to (127,000 to 325,000 PSI) to form spaced apart grooves. The sheet must then be annealed at 750° C. (1380° F.) or more so that fine recrystallized grains are formed to divide the magnetic domains and improve core loss values which survive subsequent stress relief annealing.

In U.S. Pat. No. 5,080,326, issued Jan. 14, 1992 and U.S. Pat. No. 5,123,977, issued Jun. 23, 1992 and assigned to the same assignee of this patent application, a hot deformation technique is disclosed wherein the steel sheet is heated to a temperature in the range of 1000° F. to 1400° F. (540° C. to 760° C.) and while in this state it is locally hot deformed to facilitate the development of localized fine recrystallized grains in the vicinity of the areas of localized deformations to effect heat resistant domain refinement and core loss.

While the above prior attempts have, to different degrees, met the basic objectives to which they were addressed, they have created other technical and practical problems which the present invention is designed to overcome. One such problem is the stacking factor of the core assembly of the transformer. The stacking factor has reference to the important interest in being able to stack a maximum number of scribed sheets in a given cross section which are used to make up a transformer core assembly. This criterion is addressed to the capacity or power rating and size of the transformer and hence its ultimate use and cost. The stacking dimension is "enlarged" by the degree of penetration of the localized deformations cause by scribing and the non-uniformity in a linear direction of the deformations, (i.e. variation in the depth of the deformations). These two conditions of non-uniformity and excessive penetration of some of prior deformation techniques are also objectionable because they create problems in operation of the core-winding machine and gap patterns of the elements of the core and in the ease of moving and manipulating the scribed sheets during processing in the manufacturing of the transformers.

Another problem possessed by some of the prior scribing practices employing spiral scribing projections is the adverse influence such systems have on forcing the moving strip out of its desired path of travel during scribing and the permanent twist that may be imposed in the strip. Such strip movement is some times hereinafter referred to as "tracking" or "wandering". In the first case, the misdirected or wandering strip causes the reduction of strip feeding speed and in some instances, interruption of the process and in the other, unwinding and handling difficulty in processing the scribed strip during the manufacture of the transformers.

Another problem with the prior mechanical scribing systems is the high inertia inherently represented by the single large diameter scribing or strain rolls and the high loading pressures such rolls necessitate to effect the desired local deformation. Such roll design, in addition to creating the aforesaid strip tracking condition, also tends to tear the strip, at elevated temperatures. The high loading pressures and temperatures cause objectionable thermal distortion of both the strain roll and the anvil roll and substantial deflection of the latter.

SUMMARY OF THE INVENTION

The strip product of the present invention is characterized by having mechanically refined magnetic domain wall spacings formed by mechanically scribing one face surface of the strip. The mechanical scribing is comprised of a multiplicity of closely spaced scribe lines extending generally across the width of the strip intersecting magnetic domain walls extending parallel to the rolling direction, the scribe lines being interrupted by at least one directional change across the width of the strip.

According to the method of present invention, core losses for a grain-oriented silicon steel strip are improved by the steps of passing the strip between rotatable scribing and anvil roll means to cooperate together to impart mechanical scribing on one entire surface of the strip providing mechanical scribing by imparting local deformation in the strip by projections on the outer periphery of a scribing roll, such that the scribing roll means scribes the steel with multiple chevron patterns of projections in predetermined relatively closely spaced relation across the strip width with the apexes of the chevron pattern oriented in a plane transverse to the rotation axis of the scribing roll.

BRIEF DESCRIPTION OF THE DRAWINGS

The above and other objects and features of the invention will become more apparent from the following detail description taken in connection with the accompanying drawings which form a part of this specification and in which.

DETAILED DESCRIPTION OF THE PREFERRED EMBODIMENT

Figure 1:
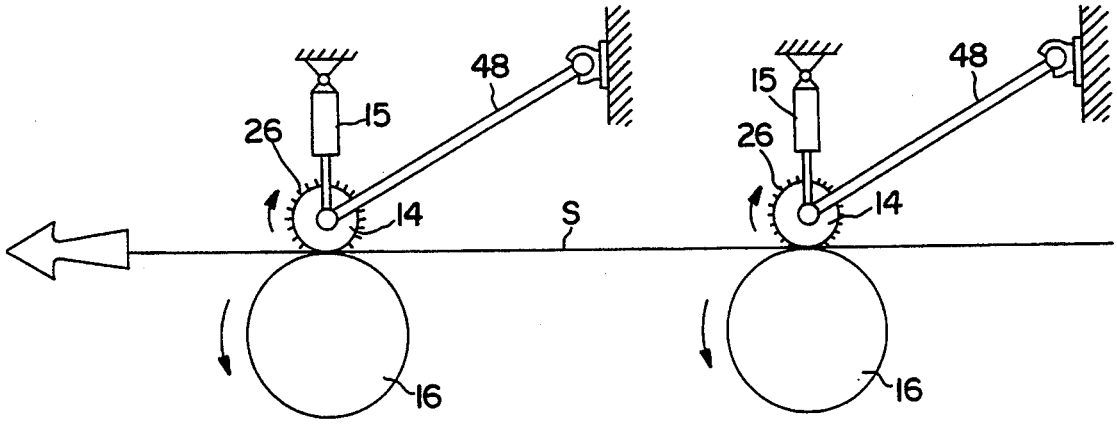
FIG. 1 is a schematic view of one form of the present invention illustrating two rows of scribing and anvil rolls.
Figure 2:
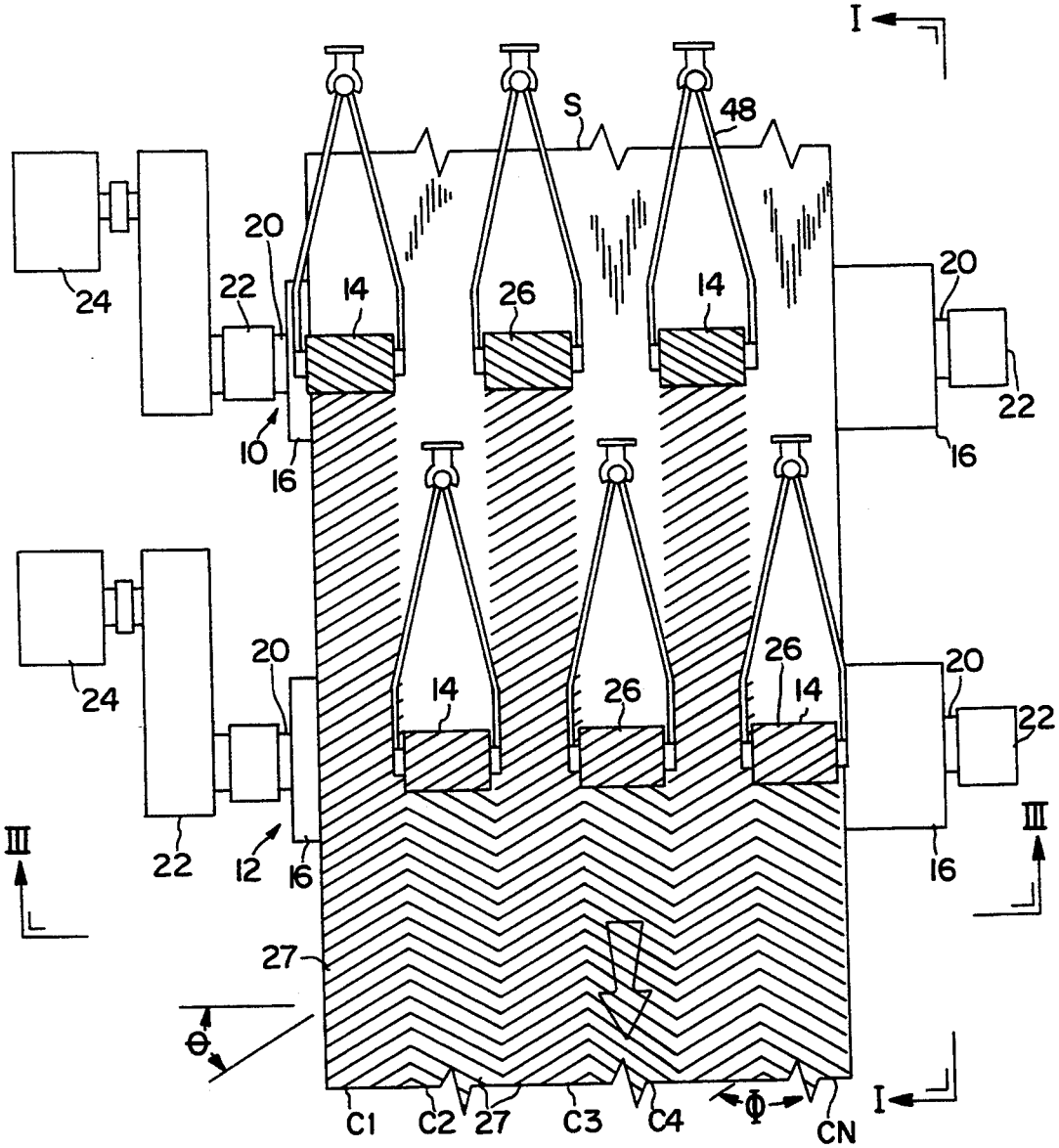
FIG. 2 is a plan view of FIG. 1.
Figure 3:
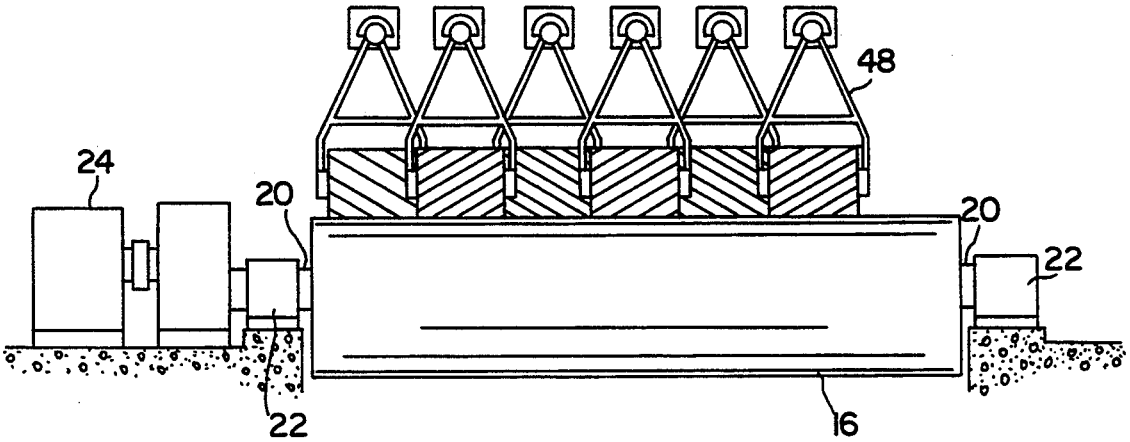
FIG. 3 is an elevational view of the anvil rolls, scribing rolls and associated structure shown in FIG. 1.

With reference to FIGS. 1–3, there is illustrated an apparatus useful to perform the method and obtain a strip product having a refined domain structure to provide electrical steels according to the present invention. The domain refinement is carried out by local mechanical deformation irrespective of whether the steel is at elevated temperature or not. As shown, there two rows, 10 and 12, of low inertia rolls 14 which are staggered such that the initially occurring row has three evenly spaced apart rolls 14 and downstream thereof there are three evenly spaced apart rolls 14. The total number of such rolls in each row is arbitrary but, preferably the total number of rolls is an even number to prevent lateral thrust on the strip because of the angled scribe patterns being imparted thereto. As shown in FIG. 2, the rolls 14 of each row are spaced apart a distance approximately equal to the axial lengths of the rolls of the other row. The aggregate of the axial lengths of the rolls of both rows are selected to at least correspond to or exceed the width of the strip to be scribed. The length of each roll 14 may range up to about one-half the strip width. Preferably, each scribing roll may have an axial length on the order of between 1 and 22 inches (2.5 to 55.9 cm) long. The arrows shown in these figures indicate the direction of travel of the strip which is also parallel to the rolling direction. The rolls 14 are each supported by a yoke 48 connected by a ball joint to foundation structure to allow freedom of lateral movement. Vertical movement of each roll is controlled by operation of a piston and cylinder assembly 15 to apply a predetermined pressure causing the operation of the scribing roll.

Directly below the scribing rolls 14 of each of the rows 10 and 12 at the opposite side of the strip, there are arranged identical anvil or press rolls 16. The rotational axis of rolls 16 extends parallel to the rotational axes of the rolls 14 thereabove and have their axes co-planar with the associated scribing rolls. The anvil rolls are adapted to serve as rigid resistant members for the scribing rolls and support the strip when fed between the cooperative set of rolls. The scribing rolls are urged by actuators 15 (FIG. 1) against the strip to effect the desired local mechanical deformation in the upper surface of the strip under a pressure sufficient to impart plastic deformation along the sites where each of protruding ridges of the scribing roller contact the strip.

In the embodiment illustrated in FIGS. 1–3, the rolls 14 are idler rolls which rotate by the frictional contact with the constantly moving strip. The strip is advanced between the rolls by a strip driving means, such as one or more well known pinch roll units, not shown and/or by driving the anvil rolls 16 as described hereinafter. The strip speed is within the range of approximately 20 to 400 feet per minute (6 to 92 meters per minute). The rolls 16 are rotatably supported by providing a support shaft 20 extending from opposite ends of the rolls and supported in bearing units 22 mounted in a well known manner, not shown. Motor gear drive units 24 are coupled to the shaft 20 to drive the rolls 16. In some application of the invention, either or both of the rolls 14 and 16 may be directly driven either to advance the strip through the roll units or, if the strip is moved by other means, to match the roll speed with the strip speed.

In the arrangement shown in FIGS. 1–3, the anvil rolls are positively driven by motor-gear drive units 24. One of the considerations as to whether the rolls are directly driven or not will be whether the strip is in a heated condition or cooler, such as at room temperature. In the heated condition the yield strength of the strip may be greatly reduced resulting in a danger that the inertia of the rolls may tear or otherwise damage the strip or cause the forming of non-uniform scribes during the scribing.

Each of the scribing rolls 14 is provided with strip deforming projections that may take any one of several different forms according to the present invention. FIGS. 2 and 3 illustrate a helical arrangement of spaced apart projections 26 formed on the outer peripheries of each scribing roll. The projections 26 extend the full face length of each roll and are constructed so that the scribe lines produced thereby in the face of the strip always extend in a direction generally transverse to the rolling direction. The scribing rolls are arranged as shown such that the ridges 26 of each scribe roll are oriented so that the scribe lines 27 in the strip are in pattern of columns C1, C2, C3, C4 - - - CN. The columns extend the length of the strip with the scribe lines of adjacent patterns merging to form a chevron design which occurs repeatedly across the width of the strip. One or more chevron patterns may be scribed on the steel strip by the alternating orientation or arrangement of staggered scribing rolls 14. The projections of each staggered scribing roll 14 is axially at an angle in alternating directions.

In a preferred embodiment the scribing pressure is selected to impart plastic deformation to the base metal of the strip and thereby cause an affect upon the magnetic domain walls. The refinement has been found to be heat resistant when recrystallized grains are formed in the strip beneath the plastically deformed surface by annealing at a temperature of, for example, 1400° F. for one minute or less. The MgO coating or other oxide coating on the strip may be refurbished to reestablish a smooth face surface, filling in the gaps where scribing occurred. Alternatively, the chevron pattern may be used to refine the magnetic domains with little or no plastic deformation of the steel strip and without damaging the coating. Such steel may exhibit non-heat resistant domain refinement.

Figure 4:
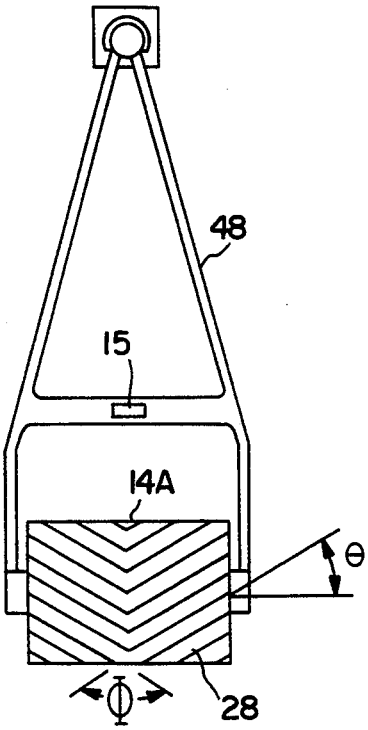
FIG. 4 is an enlarged plan view of a scribing roll illustrating a chevron scribing pattern.

In the embodiment of FIG. 4, the projections in the body of scribing roll 14A are in the form of a chevron pattern of scribing ridges 28 extending across the roll face but change direction between opposite ends of the scribing roll 14A. Furthermore, the apexes of the chevrons fall in a substantially common plane at approximately the axial longitudinal center of the scribing roll 14A. In the embodiments of FIGS. 1–3 and FIG. 4, the scribing ridges 26 and 28 are spaced apart and extend across the face surface of the scribing rolls. The pitch or spacing of the scribing ridges as measured between the valleys or scribed grooves defining two adjacent projections may be on the order of 1 to 15 mm, usually between 2 to 10 mm, preferably between 5 and 10 mm, and have a depth on the order of 0.5 to 1.0 mil. The groove formed by each scribing surface 26 and 28 extends at an angle of 45° or less and can have an angle between 10° to 20°. The helical arrangement of ridges formed by the scribing ridges produces on the surface of the strip as a result of the scribing operation pattern, scribed lines that always change direction but are always angled at an angle, $\theta$, of 45° or less, preferably between 20° and 10° from the perpendicular to the strip rolling. The arrangement of the scribed marks caused by the adjacent patterns on segments form an included angle $\phi$ of at least 90°, preferably in the range of 90° to 160° and form a chevron pattern of scribe lines on the strip across the entire width of the strip. The chevron projections are pressed against the strip under a pressure support to impose local compressive forces or stresses on a strip surface as scribe lines.

It has also been found that chevron patterns with smaller legs tend to provide further improvement in core loss values over larger chevrons. By smaller legs, it is meant that the oblique lines of the chevron are shorter, and do not extend to the end of the scribing roll, such as shown in FIG. 4. In such embodiments, two or more chevrons are provided on a scribing roll 14A such that the oblique lines or legs of the chevron may range from 0.5 to 22 inches long, preferably about 0.5 inch.

Such chevron patterns provide at least three advantages over typical mechanical scribe lines which extend substantially across the width of the sheet strip transverse to the rolling direction. First, there appears to be an improvement in maintaining the track of the strip as it passes between the scribing rolls and the anvil rolls. A tendency of the strip to "drift" or shift laterally in the plane of the sheet was observed when providing mechanical scribing that extends in a direction substantially across the strip width from edge to edge. The chevron patterns appear to minimize tracking problems. Thus the scribe lines in the scribing pattern should form equally a plus and minus $\theta$ to the scribe lines to maximize the neutralizing benefit to lateral thrust that might otherwise result when the scribe lines occur at different angles in columns or arrays. $\theta$ is the angle between the scribe lines and the normal to the easy direction of magnetization. With regard to the embodiment of FIG. 1–3, it bears particular note that the angled arrangement of the scribe lines imparted by the strip by each scribe roller impose a lateral thrust on the strip which is neutralized by selecting the number of scribe rolls and the orientation of the scribe lines produced thereby so that there is no net lateral thrust as would occur should the alternating patterns of scribe lines be the result of an unequal number of scribing rollers.

Second, there is a further improvement in core loss reductions by 5 to 10 milliwatts per pound (mwpp) at 60 $H_z$ and 1.5 T. over typical scribing which has scribe lines extending substantially across the width of the sheet strip. This is shown by the data in the following table for high permeability steel with $\mu 10$ of the order of 1920 to greatly benefit the magnetic quality by a chevron scribing pattern.

TABLE

| Scribe Line | | | Core Loss, mwpp @ 60 $H_z$ | |
|---|---|---|---|---|
| Orientation, $\theta$ | Pitch, mm | $\mu 10$ | 1.5T | 1.7T |
| None | none | 1923 | 369 | 511 |
| ±15° | 5 | 1918 | 338 (−9.6%) | 470 (−9.6%) |
| 0° | 5 | 1916 | 344 (−6.5%) | 473 (−7.3%) |
| ±15° | 10 | 1924 | 350 (−4.9%) | 480 (−5.0%) |

Third, there appears to be an improvement in handling characteristics of the scribed material during core winding operations for the transformer manufacturer. The chevron patterns appear to provide fewer winding and lacing difficulties, perhaps as the result of the absence of unidirectional scribe lines that may induce lateral thrust. Such improved winding and lacing results in improved gap patterns and higher stacking factors.

The segmented scribing roller disclosed in pending U.S. patent application Ser. No. 07,978,204, filed Nov. 17, 1992, and assigned to the same assignee as this patent application, can be used to scribe a surface of the strip while supported by a solid anvil roll to carry out the method and Obtain the strip product according to the present invention. The segmented scribing roller offers the advantage of providing uniform scribing pressure by the use of an arbor used to support inflatable bladders that apply uniform pressure or support of segments. The segments rotate about an axis and each have scribing surfaces contacting the strip for the scribing operations. It being necessary, however, to form the scribing surfaces so as to produce the requisite chevron pattern as shown and described herein.

The segmented anvil roller disclosed in pending U.S. patent application Ser. No. 07/977,359, filed Nov. 17, 1992, and assigned to the same assignee as this patent application, can be used to support the strip during scribing by any one of a variety of scribing roll patterns and roll constructions described herein. The segmented anvil roller offers the advantage of providing uniform support for the strip while contacted at the opposite face by a scribing roller having scribing surfaces arranged to produce the requisite chevron pattern shown and described herein.

The steel strip and method for producing the same according to the present invention, may utilize the very hard surface anvil or press roll as disclosed in pending U.S. application Ser. No. 07/977,584, filed Nov. 17, 1992 and assigned to the same assignee of this patent application. Such features for the anvil or press roll prevent excessive penetrations of the scribes in the steel strip and allow controlling of the degree of such penetrations to maintain high stacking factor.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A method for improving core loss of grain-oriented silicon steel strip comprising the steps of:

passing the strip between rotatable scribing and anvil roll means to cooperate together to impart mechanical scribing on one entire surface of the strip in a manner to obtain improved core loss, providing mechanical scribing by imparting local deformation in the strip by projections on the outer periphery of the scribing roll means, such that the scribing roll means scribes the steel with multiple chevron patterns of projections in closely spaced relation across the strip width with the apexes of the chevron pattern oriented in a plane transverse to the rotation axis of the scribing roll.

2. The method according to claim 1, including the further step of scribing the strip with a plurality of scribing rolls spaced across the strip width, each roll having projections which extend to opposite ends of each roll generally axially to the roll and forming a chevron pattern by the angle between merging projection patterns scribed by the adjacent rolls.

3. The method according to claim 1 including the further step of scribing the strip with a plurality of scribing rolls spaced across the strip width, each roll having projections forming at least one chevron pattern on the strip with the oblique portions of the chevron extending in the direction of the strip opposite edges.

4. The method according to claim 1 wherein scribing the strip with scribing rolls each having more than one chevron pattern.

5. The method of claim 1 wherein scribing forms chevrons with an apex having an included angle of 90 to 160 degrees.

6. The method of claim 1 wherein scribing lines on the strip spaced about 2 to 10 mm apart.

7. The method of claim 1 wherein scribing lines on the strip forming an angle of 10 to 1 degrees from the perpendicular to the strip rolling direction.

* * * * *